US005466655A

United States Patent [19]

Koike et al.

[11] Patent Number: 5,466,655

[45] Date of Patent: Nov. 14, 1995

[54] HEAT-SENSITIVE RECORDING MATERIAL

[75] Inventors: Naomasa Koike; Akira Nakano; Takao Kosaka; Naoya Sakata, all of Tokyo, Japan

[73] Assignee: Mitsubishi Paper Mills Limited, Tokyo, Japan

[21] Appl. No.: 267,030

[22] Filed: Jun. 21, 1994

[30] Foreign Application Priority Data

| | | | |
|---|---|---|---|
| Jun. 21, 1993 | [JP] | Japan | 5-149013 |
| Oct. 25, 1993 | [JP] | Japan | 5-266328 |
| Nov. 18, 1993 | [JP] | Japan | 5-289233 |
| Jan. 28, 1994 | [JP] | Japan | 6-008666 |

[51] Int. Cl.[6] ..... B41M 5/40

[52] U.S. Cl. ..... 503/209; 503/216; 503/217; 503/221; 503/225; 503/226

[58] Field of Search ..... 427/150, 151, 427/152; 503/209, 216, 217, 225, 210–212, 226

[56] References Cited

U.S. PATENT DOCUMENTS

| | | | |
|---|---|---|---|
| 3,615,481 | 10/1971 | Looney | 430/335 |
| 3,630,736 | 12/1971 | Cescon et al. | 430/343 |
| 4,663,642 | 5/1987 | Kameda et al. | 503/217 |

FOREIGN PATENT DOCUMENTS

| | | | |
|---|---|---|---|
| 0534257 | 3/1993 | European Pat. Off. | 503/209 |
| 104650 | 8/1975 | Japan | 503/209 |
| 55-39180 | 10/1980 | Japan | 428/500 |
| 57-35220 | 7/1982 | Japan | 428/500 |
| 62-160280 | 7/1987 | Japan | 503/209 |
| 458469 | 9/1992 | Japan | 428/500 |

*Primary Examiner*—B. Hamilton Hess

*Attorney, Agent, or Firm*—Oblon, Spivak, McClelland, Maier, & Neustadt

[57] ABSTRACT

A heat-sensitive recording material comprising a support and a heat-sensitive recording layer containing a leuco dye and a developer, formed on one side of the support, wherein the heat-sensitive recording layer contains an ultraviolet ray-absorbing agent, said ultraviolet ray-absorbing agent being a dimer ultraviolet ray-absorbing agent.

25 Claims, No Drawings

HEAT-SENSITIVE RECORDING MATERIAL

The present invention relates to a heat-sensitive recording material. Particularly, it relates to a heat-sensitive recording material excellent in light resistance of image areas and the background. More particularly, it relates to a heat-sensitive recording material excellent in heat resistance of the background and in storage stability of image areas.

A heat-sensitive recording material usually comprises a support and a heat-sensitive recording layer containing an electron donating, normally colorless or light-colored leuco dye and an electron accepting developer as the main components, formed on the support, and it is designed so that when heated with a thermal head, a thermal pen, a laser beam or the like, the leuco dye and the developer will react instantaneously to form a record image. Such a heat-sensitive recording material has merits such that recording can be carried out by a relatively simple apparatus, that maintenance is easy and that little noise is generated, and thus it is useful in a wide range of fields including recorders, facsimile machines, printers, computer terminals, labels and ticket vendors. Conventional heat-sensitive recording materials wherein a leuco dye and a developer are employed, had a feature that the developed color density is high, but at the same time they had drawbacks such that the background and the record image areas were likely to undergo yellowing when exposed to sunlight or room light, or the record image areas were likely to undergo discoloration. As the application of heat-sensitive recording materials has expanded, it has been desired to develop heat-sensitive recording materials excellent in resistance to such lights. Further, conventional heat-sensitive recording materials had a drawback that the storage stability of record images was poor. For example, when contacted with a plastic such as polyvinyl chloride, the record images were likely to fade due to penetration of a plasticizer or an additive contained in the plastic, or they were likely to fade when contacted with a chemical reagent contained in a food or cosmetic. Further, a drawback has been pointed out such that when letters are written on the background by a marking means, such letters are likely to undergo discoloration. Thus, it has been desired to overcome such drawbacks.

In an attempt to improve the resistance of the background and image areas to lights (hereinafter referred to as light resistance), it is known to incorporate an ultraviolet ray-absorbing agent such as a benzotriazole derivative or a benzophenone derivative to a heat-sensitive recording layer or to a protective layer formed on the heat-sensitive recording layer (Japanese Unexamined Patent Publications No. 104650/1975, No. 242878/1986 and No. 160280/1987). Specifically, 2-(5-methyl-2-hydroxyphenyl)benzotriazole, 2-(3,5-di-tert-butyl-2-hydroxyphenyl)benzotriazole, 2-(2'-hydroxy-5'-tert-octylphenyl)benzotriazole and 2-hydroxy-4-methoxybenzophenone may, for example, be mentioned. However, with these derivatives, no adequate performance has yet been obtained, such that no adequate light resistance has been obtained, the color-forming properties of the heat-sensitive papers tend to be impaired, or the storage stability has been adversely affected, particularly fogging of the background has been observed in the heat-resistance test.

It is an object of the present invention to provide a heat-sensitive recording material excellent in light resistance of the background and image areas. A further object of the present invention is to provide a heat-sensitive recording material excellent in heat resistance of the background and the storage stability of the image areas.

As a result of extensive researches to overcome the above-mentioned drawbacks of the prior art, the present inventors have found it possible to overcome yellowing of the background and discoloration of the image areas by e.g. exposure to sunlight and to obtain a heat-sensitive recording material excellent in the storage stability of the background and the image areas, by incorporating a dimer ultraviolet ray-absorbing agent to at least one of the heat-sensitive recording layer or the protective layer formed on the heat-sensitive recording layer, of a heat-sensitive recording material.

Thus, the present invention provides a heat-sensitive recording material comprising a support and a heat-sensitive recording layer containing a leuco dye and a developer, formed on one side of the support, wherein the heat-sensitive recording layer contains an ultraviolet ray-absorbing agent, said ultraviolet ray-absorbing agent being a dimer ultraviolet ray-absorbing agent.

Further, the present invention provides a heat-sensitive recording material comprising a support, a heat-sensitive recording layer containing a leuco dye and a developer, formed on one side of the support, and a protective layer containing an ultraviolet ray-absorbing agent, formed on the heat-sensitive recording layer, wherein said ultraviolet ray-absorbing agent is a dimer ultraviolet ray absorbing agent.

Now, the present invention will be described in detail with reference to the preferred embodiments.

The dimer ultraviolet ray-absorbing agents can be prepared by syntheses disclosed in e.g. Japanese Examined Patent Publications No. 39180/1980, No. 35220/1982 and No. 58469/1992. Specific compounds include, for example, 2,2'-methylenebis(3-benzyloxy-6-benzoylphenol), 2,2'-isopropylidenebis(3-methoxy-6-benzoylphenol), 2,2'-methylenebis(3-methoxy-6-benzoylphenol), 2,2'-cyclohexylidenebis(3-methoxy-6-benzoylphenol), 2,2'-methylenebis[4-methyl-6-benzotriazolyl)phenol], 2,2'-methylenebis[4-methyl-6-(5'-methylbenzotriazolyl)phenol], 2,2'-methylenebis[4-methyl-6-(5'-chlorobenzotriazolyl)phenol], 2,2'-methylenebis[4-(1,1,3,3-tetramethylbutyl)-6-benzotriazolylphenol], 2,2'-methylenebis[(4-tert-butyl-6-benzotriazolyl)phenol], 2,2'-propylidenebis[4-methyl-6-benzotriazolyl)phenol], 2,2'-isopropylidenebis[4-methyl-6-benzotriazolyl)phenol], 2,2'-isopropylidenebis[4-(1,1,3,3-tetramethylbutyl)-6-benzotriazolylphenol], and 2,2'-octylidenebis[4-methyl-6-(5'-methylbenzotriazolyl)phenol. Among these compounds, a compound of the formula 3 and 2,2'-methylenebis(3-methoxy-6-benzoylphenol) are preferred from the viewpoint of light resistance. Particularly preferred is 2,2'-methylenebis[4-(1,1,3,3-tetramethylbutyl)-6-benzotriazolephenol].

(3)

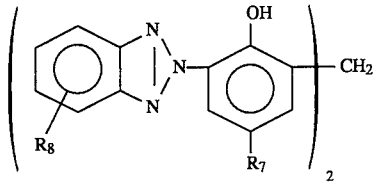

wherein $R_7$ is a $C_{1-18}$ alkyl group, and $R_8$ is a hydrogen atom, a halogen atom, an alkyl group, an alkoxy group, an aryloxy group or an aryl group.

The dimer ultraviolet ray-absorbing agents have high melting points as compared with conventional monomer ultraviolet ray-absorbing agents and do not hinder the storage properties such as heat resistance of heat-sensitive recording materials. Further, by virtue of excellent ultraviolet ray-absorbing properties which are believed to be attributable to their molecular structures, they provide excellent light resistance.

In the present invention, the dimer ultraviolet ray-absorbing agent is used preferably in an amount within a range of from 10 to 500 wt %, more preferably from 50 to 500 wt %, to the leuco dye. If the amount is too small, no adequate effects for improving the light resistance will be obtained. On the other hand, if it is too much, the color-forming properties are likely to be impaired.

The developer to be used in the present invention may, for example, be a phenol derivative, an aromatic carboxylic acid derivative, an N,N'-diarylthiourea derivative or a polyvalent metal salt such as a zinc salt of an organic compound, which has heretofore been commonly used.

Specifically, p-phenylphenol, p-hydroxyacetophenone, 4-hydroxy-4'-methyldiphenylsulfone, 4-hydroxy-4'-isopropoxydiphenylsulfone, 4-hydroxy-4'-benzenesulfonyloxydiphenylsulfone, 1,1-bis(p-hydroxyphenyl)propane, 1,1-bis(p-hydroxyphenyl)pentane, 1,1-bis(p-hydroxyphenyl)hexane, 1,1-bis(p-hydroxyphenyl)cyclohexane, 2,2-bis(p-hydroxyphenyl)propane, 2,2-bis(p-hydroxyphenyl)hexane, 1,1-bis(p-hydroxyphenyl)-2-ethylhexane, 2,2-bis(3-chloro-4-hydroxyphenyl)propane, 1,1-bis(p-hydroxyphenyl)-1-phenylethane, 1,3-di-[2-(p-hydroxyphenyl)-2-propyl]benzene, 1,3-di-[2-(3,4-dihydroxyphenyl)-2-propyl]benzene, 1,4-di-[2-(p-hydroxyphenyl)-2-propyl]benzene, 4,4'-dihydroxydiphenyl ether, 4,4'-dihydroxydiphenylsulfone, 3,3'-dichloro-4,4'-dihydroxydiphenylsulfone, 3,3'-diallyl-4,4'-dihydroxydiphenylsulfone, 3,3'-dichloro-4,4'-dihydroxydiphenylsulfide, methyl 2,2-bis(4-hydroxyphenyl)acetate, butyl 2,2-bis(4-hydroxyphenyl)acetate, 4,4'-thiobis(2-t-butyl-5-methylphenol), benzyl p-hydroxybenzoate, chlorobenzyl p-hydroxybenzoate, dimethyl 4-hydroxyphthalate, benzyl gallate and stearyl gallate may, for example, be mentioned. Among them, as a developer which is capable of providing an excellent storage stability of image areas, a salicylic acid derivative or a metal salt thereof as well as 2,4'-dihydroxydiphenylsulfone is preferably used. Among salicylic acid derivatives, a salicylic acid derivative of the formula 2 or a metal salt thereof is preferred:

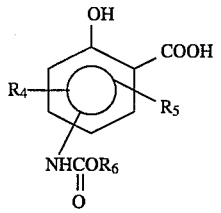

(2)

wherein each of $R_4$ and $R_5$ is a hydrogen atom, an alkyl group, an aralkyl group, an aryl group or a halogen atom, and $R_6$ is an alkyl group, an alkenyl group, an aralkyl group or an aryl group. More preferably, 4-n-octyloxycarbonylaminosalicyclic acid or a metal salt thereof is used. The compound of the formula 2 can be prepared by a method disclosed in EP0534257.

The salicyclic acid derivative may, for example, be 4-n-octyloxysalicylic acid, 4-benzyloxysalicyclic acid, 4-(4-methoxyphenoxyethoxy)salicylic acid, 4-(p-tolylethoxy)salicylic acid or 4-(p-tolylsulfonylpropyloxy)salicylic acid. Further, the salicyclic acid derivative of the formula 2 may, for example, be 3-methyloxycarbonylaminosalicylic acid, 3-ethyloxycarbonylaminosalicylic acid, 3-n-propyloxycarbonylaminosalicylic acid, 3-isopropyloxycarbonylaminosalicylic acid, 3-n-butyloxycarbonylaminosalicylic acid, 3-isobutyloxycarbonylaminosalicylic acid, 3-sec-butyloxycarbonylaminosalicylic acid, 3-n-pentyloxycarbonylaminosalicylic acid, 3-isopentyloxycarbonylaminosalicylic acid, 3-n-hexyloxycarbonylaminosalicyclic acid, 3-n-heptyloxycarbonylaminosalicyclic acid, 3-n-octyloxycarbonylaminosalicyclic acid, 3-(2'-ethylhexyl)oxycarbonylaminosalicylic acid, 3-n-nonyloxycarbonylaminosalicylic acid, 3-n-decyloxycarbonylaminosalicylic acid, 3-n-undecyloxycarbonylaminosalicylic acid, 3-n-dodecyloxycarbonylaminosalicyclic acid, 3-n-tridecyloxycarbonylaminosalicylic acid, 3-n-tetradecyloxycarbonylaminosalicylic acid, 3-n-pentadecyloxycarbonylaminosalicylic acid, 3-n-hexadecyloxycarbonylaminosalicylic acid, 3-n-heptadecyloxycarbonylaminosalicylic acid, 3-n-octadecyloxycarbonylaminosalicylic acid, 3-cyclopentyloxycarbonylaminosalicylic acid, 3-cyclohexyloxycarbonylaminosalicylic acid, 3-allyloxycarbonylaminosalicylic acid, 3-benzyloxycarbonylaminosalicylic acid, 3-phenyloxycarbonylaminosalicylic acid, 3-(4'-methylphenyl)oxycarbonylaminosalicylic acid, 3-(4'-methoxyphenyl)oxycarbonylaminosalicylic acid, 3-(4'-chlorophenyl)oxycarbonylaminosalicylic acid, 3-[2'-(4-methoxyphenyl)oxyethyl]oxycarbonylaminosalicylic acid, 4-methyloxycarbonylaminosalicylic acid, 4-ethyloxycarbonylaminosalicylic acid, 4-n-propyloxycarbonylaminosalicylic acid, 4-isopropyloxycarbonylaminosalicylic acid, 4-n-butyloxycarbonylaminosalicylic acid, 4-isobutyloxycarbonylaminosalicylic acid, 4-sec-butyloxycarbonylaminosalicylic acid, 4-n-pentyloxycarbonylaminosalicylic acid, 4-isopentyloxycarbonylaminosalicylic acid, 4-n-hexyloxycarbonylaminosalicylic acid, 4-n-heptyloxycarbonylaminosalicylic acid, 4-n-octyloxycarbonylaminosalicylic acid, 4-(2'-ethylhexyl)oxycarbonylaminosalicylic acid, 4-(n-nonyloxycarbonylaminosalicylic acid, 4-n-decyloxycarbonylaminosalicylic acid, 4-n-undecyloxycarbonylaminosalicylic acid, 4-n-dodecyloxycarbonylaminosalicylic acid, 4-n-tridecyloxycarbonylaminosalicylic acid, 4-n-tetradecyloxycarbonylaminosalicylic acid, 4-n-pentadecyloxycarbonylaminosalicylic acid, 4-n-hexadecyloxycarbonylaminosalicylic acid, 4-n-heptadecyloxycarbonylaminosalicylic acid, 4-n-octadecyloxycarbonylaminosalicylic acid, 4-cyclopentyloxycarbonylaminosalicylic acid, 4-cyclohexyloxycarbonylaminosalicylic acid, 4-allyloxycarbonylaminosalicylic acid, 4-benzyloxycarbonylaminosalicylic acid, 4-phenyloxycarbonylaminosalicylic acid, 4-(4'-methylphenyl)oxycarbonylaminosalicylic acid, 4-(4'-methoxyphenyl)oxycarbonylaminosalicylic acid, 4-(4'-chlorophenyl)oxycarbonylaminosalicylic acid, 4-[2'-(4-methoxyphenyl)oxyethyl]oxycarbonylaminosalicylic acid, 5-methyloxycarbonylaminosalicylic acid, 5-ethyloxycarbonylaminosalicylic acid, 5-n-propyloxycarbonylaminosalicylic acid, 5-isopropyloxycarbonylaminosalicylic acid, 5-n-butyloxycarbonylaminosalicylic acid, 5-isobutyloxycarbonylaminosalicylic acid, 5-sec-butyloxycarbonylaminosalicylic acid, 5-n-pentyloxycarbonylaminosalicylic acid, 5-isopentyloxycarbonylaminosalicylic acid, 5-n-hexyloxycarbonylaminosalicylic acid, 5-n-heptyloxycarbonylaminosalicylic acid, 5-n-octyloxycarbonylaminosalicylic acid, 5-(2'-ethylhexyl)oxycarbonylaminosalicylic acid, 5-(n-nonyloxycarbonylaminosalicylic acid, 5-n-decyloxycarbonylaminosalicylic acid, 5-n-undecyloxycarbonylaminosalicylic acid, 5-n-dodecyloxycarbonylaminosalicylic acid, 5-n-tridecyloxycarbonylaminosalicylic acid, 5-n-tetradecyloxycarbonylaminosalicylic acid, 5-n-pentadecyloxycarbonylaminosalicylic acid, 5-n-hexadecyloxycarbonylaminosalicylic acid, 5-n-heptadecyloxycarbonylaminosalicylic acid, 5-n-octadecyloxycarbonylaminosalicylic acid, 5-cyclopentyloxycarbonylaminosalicylic acid, 5-cyclohexyloxycarbonylaminosalicylic acid, 5-allyloxycarbonylaminosalicylic acid, 5-benzyloxycarbonylaminosalicylic acid, 5-phenyloxycarbonylaminosalicylic acid, 5-(4'-methylphenyl)oxycarbonylaminosalicylic acid, 5-(4'-methoxyphenyl)oxycarbonylaminosalicylic acid, 5-(4'-chlorophenyl)oxycarbonylaminosalicylic acid, 5-[2'-(4-methoxyphenyl)oxyethyl]oxycarbonylaminosalicylic acid, 6-methyloxycarbonylaminosalicylic acid, 6-ethyloxycarbonylaminosalicylic acid, 6-n-propyloxycarbonylaminosalicylic acid, 6-isopropyloxycarbonylaminosalicylic acid, 6-n-butyloxycarbonylaminosalicylic acid, 6-isobutyloxycarbonylaminosalicylic acid, 6-sec-butyloxycarbonylaminosalicyclic acid, 6-n-pentyloxycarbonylaminosalicyclic acid, 6-isopentyloxycarbonylaminosalicylic acid, 6-n-hexyloxycarbonylaminosalicyclic acid, 6-n-heptyloxycarbonylaminosalicyclic acid, 6-n-octyloxycarbonylaminosalicyclic acid, 6-(2'-ethylhexyl)oxycarbonylaminosalicylic acid, 6-n-nonyloxycarbonylaminosalicylic acid, 6-n-decyloxycarbonylaminosalicylic acid, 6-n-undecyloxycarbonylaminosalicylic acid, 6-n-dodecyloxycarbonylaminosalicyclic acid, 6-n-tridecyloxycarbonylaminosalicylic acid, 6-n-tetradecyloxycarbonylaminosalicylic acid, 6-n-pentadecyloxycarbonylaminosalicylic acid, 6-n-hexadecyloxycarbonylaminosalicylic acid, 6-n-heptadecyloxycarbonylaminosalicylic acid, 6-n-octadecyloxycarbonylaminosalicylic acid, 6-cyclopentyloxycarbonylaminosalicylic acid, 6-cyclohexyloxycarbonylaminosalicylic acid, 6-allyloxycarbonylaminosalicylic acid, 6-benzyloxycarbonylaminosalicylic acid, 6-phenyloxycarbonylaminosalicylic acid, 6-(4'-methylphenyl)oxycarbonylaminosalicylic acid, 6-(4'-methoxyphenyl)oxycarbonylaminosalicylic acid, 6-(4'-chlorophenyl)oxycarbonylaminosalicylic acid or 6-[2'-(4-methoxyphenyl)oxyethyl]oxycarbonylaminosalicylic acid. In the metal salt of a salicylic acid derivative of the present invention, the metal salt may contain a monovalent metal salt such as sodium, potassium or lithium, but it preferably contains a water-insoluble or hardly soluble bivalent, trivalent or tetravalent metal salt, more preferably a bivalent or trivalent metal salt.

Specific examples of the bivalent, trivalent or tetravalent metal salt include salts of zinc, cadmium, mercury, magnesium, calcium, barium, nickel, tin, gallium, chromium, copper, molybdenum, tungsten, zirconium, strontium, manganese, cobalt, titanium, aluminum and iron. Preferred are salts of zinc, calcium, barium, nickel, manganese, cobalt and aluminum. Particularly preferred is a zinc salt. The metal salt of a salicylic acid may form a solvate such as a hydrate depending upon the production condition, and such a solvate is also useful as an electron accepting compound of the present invention.

The leuco dye to be used in the present invention is not particularly limited so long as it is the one commonly used in a heat-sensitive recording sheet or pressure-sensitive recording sheet.

Specifically, the following compounds may be used.

(1) Triarylmethane compounds, such as 3,3-bis(p-dimethylaminophenyl)- 6-dimethylaminophthalide (crystal violet lactone), 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, and 3-p-dimethylaminophenyl-3-(1-methylpyrrol-2-yl)- 6-dimethylaminophthalide.

(2) Diphenylmethane compounds, such as 4,4'-(dimethylaminophenyl)benzhydrylbenzyl ether, N-chlorophenylleucoauramine, and N-2,4,5-trichlorophenylleucoauramine.

(3) Xanthene compounds, such as rhodamine B anilinolactam, rhodamine B-p-chloroanilinolactam, 3-diethylamino- 7-dibenzylaminofluoran, 3-diethylamino-7-octylaminofluoran, 3-diethylamino-7-phenylfluoran, 3-diethylamino-7-chlorofluoran, 3-diethylamino-6-chloro-7-methylfluoran, 3-diethylamino-7-(3,4-dichloroanilino)fluoran, 3-diethylamino-7-(2-chloroanilino)fluoran, 3-diethylamino-6-methyl-7-anilinofluoran, 3-dibutylamino-6-methyl-7-anilinofluoran, 3-dipentylamino-6-methyl-7-anilinofluoran, 3-(N-ethyl-N-tolyl)amino-6-methyl-7-anilinofluoran, 3-piperidino-6-methyl-7-anilinofluoran, 3-(N-ethyl-N-tolyl)amino-6-methyl-7-phenetylfluoran, 3-diethylamino-7-(4nitroanilino)fluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, and 3-(N-ethyl-N-tetrahydrofurfuryl)amino- 6-methyl-7-anilinofluoran.

(4) Thiazine compounds, such as benzoylleucomethylene Blue, and p-nitrobenzoylleucomethylene Blue.

(5) Spiro compounds, such as 3-methylspirodinaphthopyrane, 3-ethylspirodinaphthopyrane, 3,3'-dichlorospirodinaphthopyrane, 3-benzylspirodinaphthopyrane, 3-methylnaphtho-(3-methoxybenzo)spiropyrane, and 3-propylspirobenzopyrane.

These leuco dyes may be used alone or in combination as a mixture of two or more of them.

A compound of the formula 1 may be mentioned as a leuco dye particularly preferred from the viewpoint of the lasting effects of light resistance:

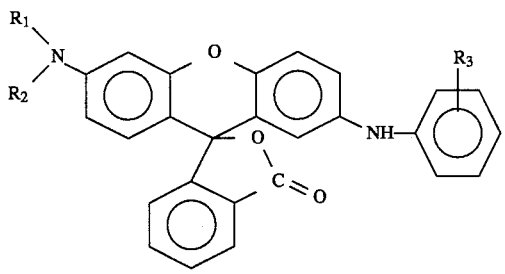

(1)

wherein each of $R_1$ and $R_2$ is an alkyl group, and $R_3$ is a halogen atom or a halogen-substituted methyl group. Specifically, it includes 3-diethylamino-7-(2-chloroanilino)fluoran, 3-dibutylamino-7-(2-chloroanilino)fluoran, 3-diethylamino-7-(2-fluoroanilino)fluoran, 3-(N-ethyl-N-isoamylamino)-7-(2-chloroanilino)fluoran, and 2-(m-trifluoromethylphenyl)amino-6-diethylaminofluoran. More preferred is 3-diethylamino-7-(m-trifluoromethylphenyl)aminofluoran.

The heat-sensitive recording material of the present invention may be used as recording sheets for facsimile, word processors or printers, or as sheets for labels or tags. Particularly when it is used as sheets for labels, it is used, in many cases, in such a form that a release paper is provided on the other side of the support usually with a pressure-sensitive adhesive layer interposed therebetween. It is further possible to provide a penetration preventing layer between the support and the pressure-sensitive adhesive layer.

The constituting elements in the heat-sensitive recording layer generally include, for example, a leuco dye, a developer, a pigment and a binder. By a further addition of an organic compound having a melting point of from 80° to 150° C., it is possible to obtain a further improved thermal response property. Specific examples of such an organic compound include an aliphatic amide such as stearamide, N-hydroxymethylstearamide, behenamide, N-hydroxymethylbehenamide, N-stearylstearamide or ethylenebisstearamide, 2-benzyloxynaphthalene, 4-benzylbiphenyl, diphenyl adipate, dibenzyl terephthalate, 1,2-bis(3,4-dimethylphenyl)ethane, m-terphenyl, dibenzyl oxalate, di(4-methylbenzyl)oxalate, di(4-chlorobenzyl)oxalate, and 1,2-bis(3-methylphenoxy)ethane.

The binder to be used for the heat-sensitive recording material includes water-soluble adhesives such as starches, hydroxyethyl cellulose, methyl cellulose, carboxylmethyl cellulose, gelatin, casein, polyvinyl alcohol, modified polyvinyl alcohol, sodium polyacrylate, an acrylic acid amide/acrylic acid ester copolymer, a three component copolymer of acrylic acid amide/acrylic acid ester/methacrylic acid, an alkali salt of a styrene/maleic anhydride copolymer and an alkali salt of an ethylene/maleic anhydride copolymer, and latexes of e.g. polyvinyl acetate, polyurethane, a polyacrylic acid ester, a styrene/butadiene copolymer, an acrylonitrile/butadiene copolymer, a methylacrylate/butadiene copolymer and an ethylene/vinyl acetate copolymer.

The pigment includes, for example, diatomaceous earth, talc, kaolin, calcined kaolin, calcium carbonate, magnesium carbonate, titanium oxide, zinc oxide, silica, aluminum hydroxide, and a urea-formalin resin.

In addition to the above, for the purpose of preventing sticking or abrasion of the head, a metal salt of a higher fatty acid such as zinc stearate or calcium stearate, a wax such as paraffin, oxidized paraffin, polyethylene, oxidized polyethylene, stearamide or castor wax, or a dispersant such as sodium dioctylsulfosuccinate, as well as a surfactant or a fluorescent dye, may be incorporated as the case requires.

As the support to be used in the present invention, paper is mainly used. However, a non-woven fabric, a plastic film, a synthetic paper, a metal foil or a composite sheet made by a combination of such materials, may be optionally used. Further, various conventional techniques commonly used in the production of heat-sensitive recording materials, such as a technique of providing an undercoat layer composed of a single layer or a plurality of layers of a pigment or a resin between the heat-sensitive recording layer and the support, may be employed.

In the present invention, to further improve the solvent resistance, a protective layer may further be provided on the heat-sensitive recording layer. For this purpose, a water-soluble resin such as polyvinyl alcohol or an aqueous emulsion may be coated, and a pigment, wax or a water resistant agent may further be incorporated as the case requires.

The coated amount of the heat-sensitive recording layer is usually within a range of from 0.1 to 1.0 g/m$^2$ as represented by the coated amount of the leuco dye.

Now, the present invention will be described in further detail with reference to Examples. However, it should be understood that the present invention is by no means restricted to such specific Examples.

In the following Examples, "parts" and "%" mean "parts by weight" and "% by weight", respectively.

EXAMPLE 1

Preparation of a heat-sensitive recording material (A) Preparation of a heat-sensitive coating liquid 30 Parts of 3-dibutylamino-6-methyl-7-anilinofluoran as a leuco dye was pulverized together with 70 parts of a 2.5% polyvinyl alcohol aqueous solution in a Dyno mill (a sand mill manufactured by WEB Co.) to obtain a dispersion of the leuco dye having a volume average particle size of at most 2 μm. Then, as developers, 40 parts of 2,2-bis(4-hydroxyphenyl)propane and 50 parts of 2-benzyloxynaphthalene were pulverized together with 210 parts of a 2.5% polyvinyl alcohol aqueous solution in a Dyno mill (a sand mill manufactured by WEB Co.) to obtain a dispersion of the developers having a volume average particle size of at most 2 μm. Further, 50 parts of 2,2'-methylenebis[4-(1,1,3,3-tetramethylbutyl)-6-benzotriazolyl)phenol] as an ultraviolet ray-absorbing agent was pulverized together with 117 parts of a 2.5% polyvinyl alcohol aqueous solution in a Dyno mill (a sand mill manufactured by WEB Co.) to obtain a dispersion of the ultraviolet ray-absorbing agent having a volume average particle size of at most 2 μm. The above-mentioned three types of dispersions were mixed, and then the following components were added thereto with stirring. The mixture was thoroughly mixed to obtain a heat-sensitive coating liquid.

| | |
|---|---|
| 50% calcium carbonate aqueous dispersion | 100 parts |
| 40% zinc stearate aqueous dispersion | 25 parts |
| 10% polyvinyl alcohol aqueous solution | 200 parts |
| Water | 280 parts |

(B) Preparation of a heat-sensitive coating paper

On base paper having a weight of 40 g/m$^2$, a coating liquid having the following composition was coated so that the coated amount of solid content would be 9 g/m$^2$, followed by drying to obtain a heat-sensitive coating paper.

| | |
|---|---|
| Calcined kaolin | 100 parts |
| 50% styrene butadiene latex aqueous dispersion | 24 parts |
| Water | 200 parts |

(C) Preparation of a heat-sensitive recording material

The heat-sensitive coating liquid prepared in (A) was coated on the heat-sensitive coating paper prepared in (B) so that the coated amount of solid content would be 4 g/m$^2$, followed by drying and then the coated paper was treated by calendering so that the Beck smoothness would be from 600 to 800 seconds to obtain a heat-sensitive recording material.

EXAMPLE 2

A heat-sensitive recording material was prepared in the same manner as in Example 1 except that 2,2'-octylidenebis[4-methyl-6-(5'-methylbenzotriazolyl)phenol] was used instead of 2,2'-methylenebis[4-(1,1,3,3-tetramethylbutyl)-6-benzotriazolyl)phenol] used as an ultraviolet ray-absorbing agent in Example 1.

EXAMPLE 3

A heat-sensitive recording material was prepared in the same manner as in Example 1 except that 3-diethylamino-7-(2-chloroanilino)fluoran was used instead of 3-dibutylamino-6-methyl-7-anilinofluoran used as a leuco dye in Example 1.

EXAMPLE 4

A heat-sensitive recording material was prepared in the same manner as in Example 1 except that 3-diethylamino-7-(m-trifluoromethylanilino)fluoran was used instead of 3-dibutylamino-6-methyl-7-anilinofluoran used as a leuco dye in Example 1.

EXAMPLE 5

A heat-sensitive recording material was prepared in the same manner as in Example 4 except that 2,2'-methylenebis(3-methoxy-6-benzoylphenol) was used instead of 2,2'-methylenebis[4-(1,1,3,3-tetramethylbutyl)-6-benzotriazolyl)phenol] used as an ultraviolet ray-absorbing agent in Example 4.

EXAMPLE 6

A heat-sensitive recording material was prepared in the same manner as in Example 4 except that zinc 4-(4-methoxyphenoxyethoxy)salicylate was used instead of 2,2-bis(4-hydroxyphenyl)propane used as a developer in Example 4.

EXAMPLE 7

A heat-sensitive recording material was prepared in the same manner as in Example 4 except that zinc 4-n-octyloxycarbonylaminosalicylate was used instead of 2,2-bis(4-hydroxyphenyl)propane used in Example 4.

EXAMPLE 8

A heat-sensitive recording material was prepared in the same manner as in Example 7 except that zinc 4-n-hexyloxycarbonylaminosalicylate was used instead of zinc 4-n-octyloxycarbonylaminosalicylate used in Example 7.

EXAMPLE 9

A heat-sensitive recording material was prepared in the same manner as in Example 7 except that zinc 4-phenyloxycarbonylaminosalicylate was used instead of zinc 4-n-octyloxycarbonylaminosalicylate used in Example 7.

EXAMPLE 10

A heat-sensitive recording material was prepared in the same manner as in Example 7 except that 2,4'-dihydroxydiphenylsulfone was used instead of zinc 4-n-octyloxycarbonylaminosalicylate used in Example 7.

EXAMPLE 11

A heat-sensitive recording material was prepared in the same manner as in Example 7 except that 2,2'-methylenebis(3-methoxy-6-benzoylphenol) was used instead of 2,2'-methylenebis[4-(1,1,3,3-tetramethylbutyl)-6-benzotriazolyl)phenol] used as an ultraviolet ray-absorbing agent in Example 7.

EXAMPLE 12

On the heat-sensitive recording material of Example 7, a coating liquid having the following composition was coated as a protective layer so that the dried coated amount would be 3 g/m$^2$, followed by drying and then the coated recording material was treated by calendering so that the Beck smoothness would be from 600 to 800 seconds to obtain a heat-sensitive recording material.

1) Preparation of a coating liquid for a protective layer

| | |
|---|---|
| 8% polyvinyl alcohol aqueous solution | 100 parts |
| 40% zinc stearate dispersion | 5 parts |
| 20% silica dispersion | 50 parts |

The above aqueous solution and dispersions were mixed to obtain a coating liquid for a protective-layer.

EXAMPLE 13

A heat-sensitive recording layer was formed in the same manner as in Example 4, and a coating liquid for a protective layer having the following composition was coated on the heat-sensitive recording layer so that the dried coated amount would be 3 g/m$^2$, followed by drying and then the coated layer was treated by calendering so that the Beck smoothness would be from 600 to 800 seconds to obtain a heat-sensitive recording material.

1) Preparation of a coating liquid for a protective layer

A liquid obtained by mixing 6 parts of 2,2'-methylenebis [4-(1,1,3,3-tetramethylbutyl)-6-benzotriazolylphenol] and 10 parts of a 5% polyvinyl alcohol aqueous solution, was pulverized in a Dyno mill so that the volume average particle size would be at most 2.0 μm, and then 100 parts of a 8% polyvinyl alcohol aqueous solution, 5 parts of a 40% zinc stearate dispersion and 50 parts of a 20% silica dispersion were further added thereto to obtain a coating liquid for a protective layer.

EXAMPLE 14

A heat-sensitive recording material was prepared in the same manner as in Example 13 except that 2,2'-methylenebis[4-(1,1,3,3-tetramethylbutyl)-6-benzotriazolylphenol] used as an ultraviolet ray-absorbing agent in the heat-sensitive coating liquid in Example 13 was omitted.

EXAMPLE 15

A heat-sensitive recording material was prepared in the same manner as in Example 14 except that zinc 4-(4-methoxyphenoxyethoxy)salicylate was used in stead of 2,2-bis(4-hydroxyphenyl)propane used in the heat-sensitive recording layer in Example 14.

EXAMPLE 16

A heat-sensitive recording material was prepared in the same manner as in Example 14 except that zinc 4-n-octyloxycarbonylaminosalicylate was used instead of 2,2-bis(4-hydroxyphenyl)propane used in the heat-sensitive recording layer in Example 14.

EXAMPLE 17

A heat-sensitive recording material was prepared in the same manner as in Example 14 except that 2,4'-dihydroxydiphenylsulfone was used instead of 2,2-bis(4-hydroxyphenyl)propane used in the heat-sensitive recording layer in Example 14.

EXAMPLE 18

A heat-sensitive recording material was prepared in the same manner as in Example 14 except that 3-diethylamino-7-(2-chloroanilino)fluoran was used instead of 3-dibutylamino-6-methyl-7-anilinofluoran used as a leuco dye in Example 14.

EXAMPLE 19

A heat-sensitive recording material was prepared in the same manner as in Example 14 except that 3-dibutylamino-6-methyl-7-anilinofluoran was used instead of 3-diethylamino-7-(m-trifluoromethylanilino)fluoran used as a leuco dye in Example 14.

EXAMPLE 20

A heat-sensitive recording material was prepared in the same manner as in Example 14 except that 2,2'-methylenebis(3-methoxy-6-benzoylphenol) was used instead of 2,2'-methylenebis[4-(1,1,3,3-tetramethylbutyl)-6-benzotriazolylphenol] used as an ultraviolet ray-absorbing agent in Example 14.

Comparative Example 1

A heat-sensitive recording material was prepared in the same manner as in Example 4 except that 2,2'-methylene bis[4-(1,1,3,3-tetramethylbutyl)-6-benzotriazolylphenol] used in Example 4 was omitted.

Comparative Example 2

A heat-sensitive recording material was prepared in the same manner as in Example 1 except that 2,2'-methylenebis [4-(1,1,3,3-tetramethylbutyl)-6-benzotriazolylphenol] used in Example 1 was omitted.

Comparative Example 3

A heat-sensitive recording material was prepared in the same manner as in Example 4 except that 2-(5-methyl-2-hydroxyphenyl)benzotriazole was used instead of 2,2methylenebis[4-(1,1,3,3-tetramethylbutyl)-6-benzotriazolylphenol] used in Example 4.

Comparative Example 4

A heat-sensitive recording material was prepared in the same manner as in Example 4 except that 2-hydroxy-4-methoxybenzophenone was used instead of 2,2-methylenebis[4-(1,1,3,3-tetramethylbutyl)-6-benzotriazolylphenol] used in Example 4.

Comparative Example 5

A heat-sensitive recording material was prepared in the same manner as in Example 14 except that 2,2'-methylenebis[4-(1,1,3,3-tetramethylbutyl)-6-benzotriazolylphenol] used in the protective layer in Example 14 was omitted.

Comparative Example 6

A heat-sensitive recording material was prepared in the same manner as in Example 14 except that 2-(5-methyl-2-hydroxyphenyl)benzotriazole was used instead of 2,2'-methylenebis[4-(1,1,3,3-tetramethylbutyl)-6-benzotriazolylphenol] used in the protective layer in Example 14.

Comparative Example 7

A heat-sensitive recording material was prepared in the same manner as in Example 14 except that 2-hydroxy-4-methoxybenzophenone was used instead of 2,2'-methylenebis[4-(1,1,3,3-tetramethylbutyl)-6-benzotriazolylphenol] used in the protective layer in Example 14.

The heat-sensitive recording materials prepared in the above Examples and Comparative Examples were subjected to the following evaluations.

Evaluations

Formation of an image area

Each of the thus prepared specimen sheets was put through a facsimile tester TH-PMD, manufactured by Okura Denki K.K., where an area of a solid pattern was printed using a thermal head having a dot density of 8 dots/mm and a resistance of 1290 ohm, and by conducting an electric current to it under a voltage of 21 V and a pulse duration of 1.0 msec.

Light resistance test of the background and the image area

The light resistance test was conducted by treatment by means of a xenon arc weatherometer Ci35W for 12 hours under such conditions that the radiation illuminance was 0.39 W/m2 (at 340 nm), the ambient temperature was 40° C. and the humidity was 25%, whereby the color difference changes (ΔE*ab) of the background and the image area were measured by CR200 manufactured by Minolta Camera Co., Ltd. in accordance with the CIE-1976 L*a*b* system recommended by the Commission Internationale de L'Echairage (abbreviated as CIE) in 1976. ΔE*ab of 6 or less indicates a good level, and ΔE*ab of 2.5 or less indicates an excellent level where no substantial deterioration is observed.

Heat resistance test of the background

Each of the specimen sheets was placed in an oven and was left to stand for 24 hours under a temperature of 60° C. After the treatment, color density of the background (i.e., fogging) was measured by a Macbeth densitometer. The developed color density of 0.20 or less indicates a good level.

Moist heat resistance test of the image area

Each of the specimen sheets was placed in a conditioner and was left to stand for 24 hours under a relative humidity of 90% at 40° C. After the treatment, color density of the solid image was measured by a Macbeth densitometer. The color density of 0.8 or higher indicates that the moist heat resistance is acceptable, i.e., the image remained legible; the color density of 1.0 or higher, the moist heat resistance better, i.e., better legibility.

TABLE 1

| Example or Comparative Example | Developed color density | ΔE*ab Back-ground | ΔE*ab Image area | Heat resistance test | Moist heat resistance test |
|---|---|---|---|---|---|
| Example 1 | 1.31 | 5.1 | 5.2 | 0.17 | 0.87 |
| Example 2 | 1.30 | 5.9 | 5.5 | 0.19 | 0.88 |
| Example 3 | 1.29 | 1.8 | 3.1 | 0.15 | 0.82 |
| Example 4 | 1.31 | 1.4 | 1.8 | 0.16 | 0.86 |
| Example 5 | 1.30 | 2.3 | 2.7 | 0.15 | 0.83 |
| Example 6 | 1.31 | 1.5 | 2.0 | 0.19 | 1.04 |
| Example 7 | 1.30 | 1.5 | 2.1 | 0.12 | 1.12 |
| Example 8 | 1.28 | 1.7 | 1.9 | 0.14 | 1.08 |

TABLE 1-continued

| Example or Comparative Example | Developed color density | ΔE*ab Back-ground | ΔE*ab Image area | Heat resistance test | Moist heat resistance test |
|---|---|---|---|---|---|
| Example 9 | 1.29 | 1.6 | 2.1 | 0.18 | 1.10 |
| Example 10 | 1.31 | 1.5 | 2.2 | 0.17 | 1.08 |
| Example 11 | 1.30 | 2.4 | 3.1 | 0.18 | 1.13 |
| Example 12 | 1.29 | 1.4 | 1.9 | 0.13 | 1.14 |
| Example 13 | 1.30 | 1.5 | 1.9 | 0.18 | 0.86 |
| Example 14 | 1.28 | 1.4 | 2.1 | 0.15 | 0.85 |
| Example 15 | 1.29 | 1.6 | 2.2 | 0.14 | 1.03 |
| Example 16 | 1.28 | 1.6 | 1.8 | 0.12 | 1.16 |
| Example 17 | 1.30 | 1.5 | 2.0 | 0.14 | 1.10 |
| Example 18 | 1.31 | 2.0 | 2.8 | 0.15 | 0.81 |
| Example 19 | 1.28 | 5.6 | 4.9 | 0.13 | 0.90 |
| Example 20 | 1.30 | 2.4 | 3.2 | 0.14 | 0.87 |
| Comparative Example 1 | 1.29 | 12.3 | 9.5 | 0.14 | 0.86 |
| Comparative Example 2 | 1.30 | 17.2 | 17.5 | 0.15 | 0.88 |
| Comparative Example 3 | 1.29 | 6.7 | 7.0 | 0.36 | 0.84 |
| Comparative Example 4 | 1.31 | 7.5 | 7.9 | 0.34 | 0.84 |
| Comparative Example 5 | 1.31 | 12.6 | 9.1 | 0.14 | 0.85 |
| Comparative Example 6 | 1.29 | 6.5 | 6.7 | 0.17 | 0.83 |
| Comparative Example 7 | 1.28 | 7.4 | 7.7 | 0.18 | 0.85 |

It is apparent from Table 1 that by using a dimer ultraviolet ray-absorbing agent of the present invention, good properties can be obtained with little fogging of the background or little discoloration of the image area in the light resistance test, and that the color development of the background which is observed in the heat resistance test in a case where a monomer ultraviolet ray-absorbing agent is incorporated, can be suppressed. Further, by use of a leuco dye of the formula 1, the light resistance is improved, and such an effect is particularly remarkable when 3-diethylamino-7-(m-trifluoromethylanilino)fluoran is used. With respect to the developer, when a salicylic acid derivative or 2,4'-dihydroxydiphenylsulfone is used, excellent properties can be obtained also in the storage stability in the moist heat resistance test of the image area.

What is claimed is:

1. A heat-sensitive recording material, comprising:

a support and a heat-sensitive recording layer containing a leuco dye and a developer selected from the group consisting of a phenol derivative, an aromatic carboxylic acid derivative, and a polyvalent metal salt of an organic compound, formed on one side of the support, wherein the heat-sensitive recording layer contains an ultraviolet ray-absorbing agent, said ultraviolet ray-absorbing agent being a dimer ultraviolet ray-absorbing agent.

2. The heat-sensitive recording material according to claim 1, wherein the leuco dye is a compound of the formula 1:

(1)

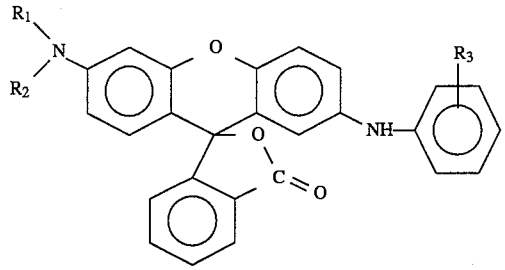

wherein each of $R_1$ and $R_2$ is an alkyl group, and $R_3$ is a halogen atom or a halogen-substituted methyl group.

3. The heat-sensitive recording material according to claim 2, wherein the leuco dye is 3-diethylamino-7-(m-trifluoromethylphenyl)aminofluoran.

4. The heat-sensitive recording material according to claim 1, wherein the developer is a salicyclic acid derivative or a metal salt thereof.

5. The heat-sensitive recording material according to claim 4, wherein the developer is a salicyclic acid derivative of the formula 2 or a metal salt thereof:

(2)

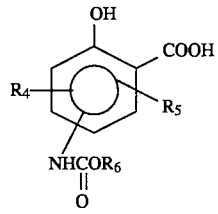

wherein each of $R_4$ and $R_5$ is a hydrogen atom, an alkyl group, an aralkyl group, an aryl group or a halogen atom, and $R_6$ is an alkyl group, an alkenyl group, an aralkyl group or an aryl group.

6. The heat-sensitive recording material according to claim 5, wherein the developer is 4-n-octyloxycarbonylaminosalicylic acid or a metal salt thereof.

7. The heat-sensitive recording material according to claim 1, wherein the developer is 2,4'-dihydroxydiphenylsulfone.

8. The heat-sensitive recording material according to claim 1, wherein the dimer ultraviolet ray-absorbing agent is a compound of the formula 3:

(3)

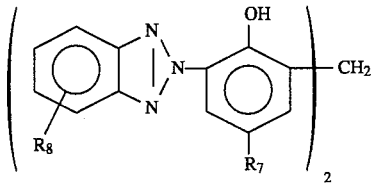

wherein $R_7$ is a $C_{1-18}$ alkyl group, and $R_8$ is a hydrogen atom, a halogen atom, an alkyl group, an alkoxy group, an aryloxy group or an aryl group.

9. The heat-sensitive recording material according to claim 8, wherein the dimer ultraviolet ray-absorbing agent is 2,2'-methylenebis[4-(1,1,3,3-tetramethylbutyl)-6-benzotriazolylphenol].

10. The heat-sensitive recording material according to claim 1, wherein the dimer ultraviolet ray-absorbing agent is 2,2'-methylenebis(3-methoxy-6-benzoylphenol).

11. The heat-sensitive recording material according to claim 1, wherein a protective layer is formed on the heat-sensitive recording layer.

12. The heat-sensitive recording material according to claim 1, wherein a release paper is provided on the other side of the support with a pressure-sensitive adhesive layer interposed therebetween.

13. The heat-sensitive recording material according to claim 1, wherein said dimer ultraviolet ray-absorbing agent is employed in an amount ranging from 10 to 500 weight % based on the weight of leuco dye in the heat-sensitive recording layer.

14. A heat-sensitive recording material comprising a support, a heat-sensitive recording layer containing a leuco dye and a developer, formed on one side of the support, and a protective layer containing an ultraviolet ray-absorbing agent, formed on the heat-sensitive recording layer, wherein said ultraviolet ray-absorbing agent is a dimer ultraviolet ray absorbing agent.

15. The heat-sensitive recording material according to claim 14, wherein the heat-sensitive recording layer contains a dimer ultraviolet ray-absorbing agent.

16. The heat-sensitive recording material according to claim 14, wherein the leuco dye is a compound of the formula 1:

(1)

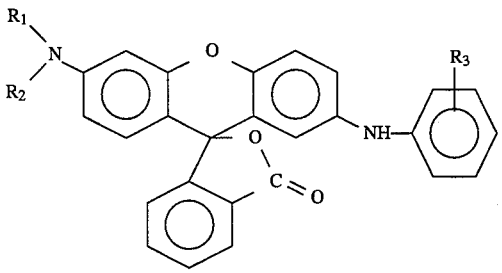

wherein each of $R_1$ and $R_2$ is an alkyl group, and $R_3$ is a halogen atom or a halogen-substituted methyl group.

17. The heat-sensitive recording material according to claim 16, wherein the leuco dye is 3-diethylamino-7-(m-trifluoromethylphenyl)aminofluoran.

18. The heat-sensitive recording material according to claim 14, wherein the developer is a salicyclic acid derivative or a metal salt thereof.

19. The heat-sensitive recording material according to claim 18, wherein the developer is a salicyclic acid derivative of the formula 2 or a metal salt thereof:

(2)

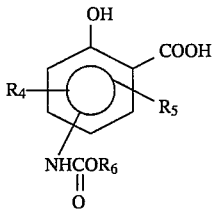

wherein each of $R_4$ and $R_5$ is a hydrogen atom, an alkyl group, an aralkyl group, an aryl group or a halogen atom, and $R_6$ is an alkyl group, an alkenyl group, an aralkyl group or an aryl group.

20. The heat-sensitive recording material according to claim 19, wherein the developer is 4-n-octyloxycarbonylaminosalicylic acid or a metal salt thereof.

21. The heat-sensitive recording material according to claim 14, wherein the developer is 2,4'-dihydroxydiphenylsulfone.

22. The heat-sensitive recording material according to claim 14, wherein the dimer ultraviolet ray-absorbing agent is a compound of the formula 3:

(3)

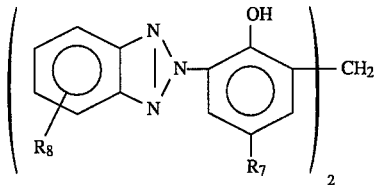

wherein $R_7$ is a $C_{1-18}$ alkyl group, and $R_8$ is a hydrogen atom, a halogen atom, an alkyl group, an alkoxy group, an aryloxy group or an aryl group.

23. The heat-sensitive recording material according to claim 22, wherein the dimer ultraviolet ray-absorbing agent is 2,2'-methylenebis[4-(1,1,3,3-tetramethylbutyl)-6-benzotriazolylphenol].

24. The heat-sensitive recording material according to claim 14, wherein the dimer ultraviolet ray-absorbing agent is 2,2'-methylenebis(3-methoxy-6-benzoylphenol).

25. The heat-sensitive recording material according to claim 14, wherein a release paper is provided on the other side of the support with a pressure-sensitive adhesive layer interposed therebetween.

* * * * *